United States Patent [19]

Young, Jr.

[11] Patent Number: 5,052,269

[45] Date of Patent: Oct. 1, 1991

[54] ACOUSTIC-ELECTRIC GUITAR WITH INTERIOR NECK EXTENSION

[76] Inventor: Lawrence P. Young, Jr., R.R. #1, Box 86, Gravette, Ark. 72736

[21] Appl. No.: 590,812

[22] Filed: Oct. 1, 1990

Related U.S. Application Data

[63] Continuation-in-part of Ser. No. 385,067, Jul. 26, 1989.

[51] Int. Cl.[5] ..... G10D 3/00

[52] U.S. Cl. ..... 84/728; 84/743; 84/291

[58] Field of Search ..... 84/723-734, 84/743, 293, 267, 291-293

[56] References Cited

U.S. PATENT DOCUMENTS

| | | | |
|---|---|---|---|
| 607,359 | 7/1898 | Forrest | 84/313 |
| 653,521 | 7/1900 | Montoya | 84/267 |
| 1,889,408 | 12/1932 | Larson | 84/293 |
| 2,020,557 | 11/1935 | Loar | 84/726 |
| 2,204,150 | 6/1940 | Quattrociocche | 84/267 |
| 2,660,912 | 12/1953 | Prescott | 84/291 |
| 3,302,507 | 2/1967 | Fender | 84/291 X |
| 3,685,385 | 8/1972 | Rendell | 84/291 X |
| 3,699,837 | 10/1972 | Annessa | 84/291 |
| 3,780,202 | 12/1973 | Law | 84/726 |
| 4,226,156 | 10/1980 | Hyakutake | 84/DIG. 12 |
| 4,227,434 | 10/1980 | DiMarzio | 84/723 |
| 4,235,143 | 11/1980 | Hoexter | 84/726 |
| 4,254,683 | 3/1981 | Nulman | 84/DIG. 3 |
| 4,538,497 | 9/1985 | Smith | 84/291 |
| 4,539,886 | 4/1990 | Hoffart | 84/726 |
| 4,913,024 | 8/1990 | Carriveau | 84/293 X |

*Primary Examiner*—William M. Shoop, Jr.
*Assistant Examiner*—Brian Sircus
*Attorney, Agent, or Firm*—Richard C. Litman

[57] ABSTRACT

An acoustic guitar is provided with a solid neck extension mounted between the front and rear blocks of the hollow body. Electric pickups and the control panel are mounted to this neck extension and extend up through holes in the top sound plate so as to be in the normal position for an electric guitar. The solid base for the pickups helps to prevent feedback as is usually associated with pickups mounted on the top sound plate.

8 Claims, 2 Drawing Sheets

FIG. 3
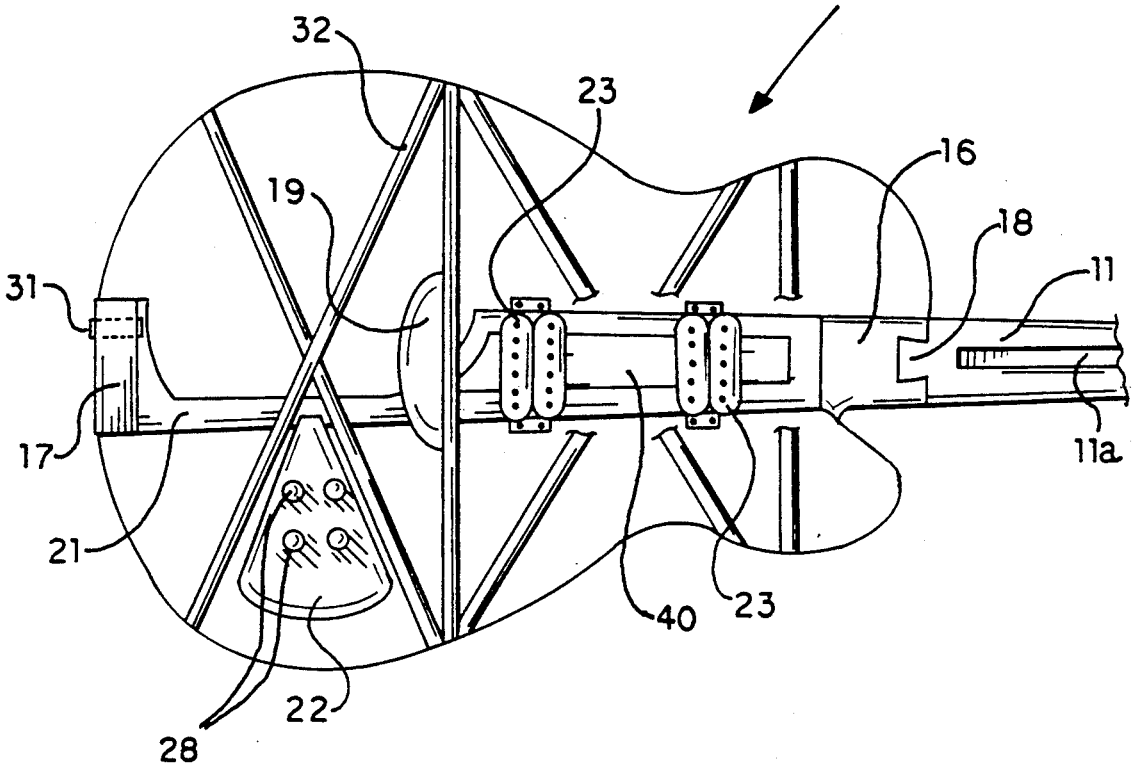
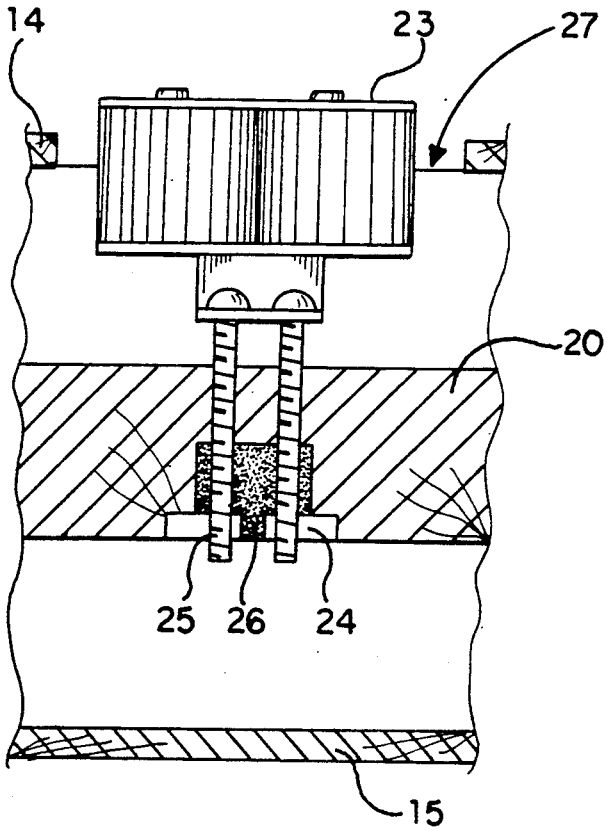
FIG. 4

ACOUSTIC-ELECTRIC GUITAR WITH INTERIOR NECK EXTENSION

BACKGROUND OF THE INVENTION

1. Field of the Invention

This application is a continuation-in-part of application Ser. No. 07/385,067, filed July 26, 1989 by the same inventor.

The present invention relates to hollow-bodied acoustic guitars. More particularly, it relates to hollow-bodied acoustic guitars with electric pickups The present invention provides an acoustic-electric guitar that doesn't feed back, as is common with known acoustic-electric guitars. Conventional acoustic-electric guitars usually have the electric pickup mounted on the top sound plate or over the sound hole of the guitar. Sound energy from an amplified speaker causes the hollow body to resonate, thus causing the guitar to give off booming feedback back to the speakers.

2. Description of the Prior Art

Stringed acoustic instruments such as guitars need to have lightly-built bodies in order to resonate properly and give a loud, pleasing sound. This is especially true of the spruce top plate, which is the most important acoustic element. On the other hand, these instruments must be robust enough to withstand ordinary use, and to resist the tension in the strings. This tension can lead to warping, detuning, and breakage if the instrument body is not strong enough. An idea of the force involved can be gotten from the fact that the nylon strings of classic guitar would support a 120-pound weight at concert pitch. Steel strings are under much more tension. Multiple strings, as on mandolins and 12-string guitars, require careful bracing of the top plate.

One solution to this problem is the use of a central interior neck extension. This member, extending from the neck to the block opposite, adds some mechanical support to the body.

A number of U.S. patents teach the use of a longitudinal interior neck extension. Among them are Fender, 3,302,507; Prescott, 2,660,912; Quattrociocche, 2,204,150; Montoya, 653,521; Forrest, 607,359; and Larson, 1,889,408.

Acoustic guitars sometimes include electric pickups so that they can function either way, acoustically or electrically. The pickups are usually either magnetic coils which sense the steel string by varying magnetic flux, or crystal or piezoelectric pressure sensors mounted under the bridge.

The magnetic pickups must be mounted close to the strings, or the very weak flux changes will not give sufficient volume. For this reason magnetic pickups have been mounted on the top plate, under the strings. Problems sometimes occur with this mounting when mechanical vibrations of the spruce top plate influence the electrical output of the pickups. The top plate vibrates more than any other part of an acoustic guitar.

This mechanical influence may distort the electrical output of the pickups. Also, since the thin top plate vibrates in response to ambient sound, the loudly amplified pickup output from nearby speakers can cause the top plate-mounted pickup to act as a microphone, leading to the loud squeals called "feedback".

Carriveau, in U.S. Pat. No. 4,913,024, discloses an acoustic-electric guitar with back and sides formed by routing wood from a thick plank, as in making a dugout canoe. The space is covered with a top plate which acts as a sound board. Pickups are mounted through openings in the sound board. It is unclear from the disclosure how the pickups are fastened in place; they apparently are adhered to the sound board itself, since Carriveau states in col. 6, lines 9–16, that the chamber within is acoustically sealed, which implies either adhesive or caulking between the pickups 100, 104 and the sound board 30. Alternatively, the figures may be interpreted to show that the pickups are mounted to longitudinal braces, which braces are mounted to the underside of the sound board. Under either interpretation, the pickups are directly connected to the vibrating sound board and are subject to mechanical influence. Thus Carriveau does not teach a method of isolating magnetic pickups from the top plate.

Law, in U.S. Pat. No. 3,780,202, teaches the use of a magnetic pickup mounted on a bracket riding on an interior neck extension. The pickup senses the vibrations of steel banjo strings through the banjo head or skin, which ordinarily has no magnetic properties to interfere with the pickup's sensing of the string vibrations.

Since a banjo head cannot be pierced without destroying its tone, there is seen no suggestion in the Law patent of mounting a pickup on an interior neck extension, and protruding the pickup through the face of the instrument adjacent the strings.

The position of Law's pickup is highly adjustable. This is intended to provide various timbres and volumes. It is well known in the art that magnetic pickups produce various timbres depending upon their distance from the bridge, and various volumes depending upon their distance from the strings. The Law pickup bracket allows these variations by translating the pickup, and also allows both timbre and volume differentials between individual strings by rotating the pickup.

The Law device avoids feedback, in all positions of the pickup, by the mechanical isolation of the pickup on a massive, rigid, braced neck extension not directly connected to the vibrating sounding head. The isolation is very great unless the pickup actually touches the skin of the head. Since touching would ruin the tone of the instrument by damping the head, as well as lead to feedback, this is clearly not intended.

The timbre and volume modifications of sound in Law's invention is unrelated to the feedback problem: there are many pickup positions where there is no touching, and no feedback; adjustability among these positions to vary the timbre is unrelated to feedback, in regard to which all the positions are the same.

Loar, in U.S. Pat. No. 2,020,557, shows a guitar with a transverse member running across the wide lower bout of the guitar, the member not touching either the front or back sound plates. The transverse member supports a magnetic coil device which responds to mechanical vibrations. The device is placed directly below a hole through the front plate (sound board). A special bridge is placed directly above the hole. Adjustable-length rods extend through the hole from the bridge to the device. By adjusting the length of the rods, the strings may be made to vibrate the sound board, the device, or both, by pressing the rods against the device or by lifting the bridge off the sound board.

These rods have no electrical function; they merely transmit vibration from the bridge to the device beneath. Thus, Loar does not teach a magnetic device or pickup extending through the sound board.

DiMarzio, in U.S. Pat. No. 4,227,434, shows a pickup bracket for mounting the pickup within a round sound hole on the front plate of a guitar. The pickup extends through the hole.

Other commercially-available devices clip a pickup onto one edge of a sound hole. These pickups are merely microphones.

Thus, the prior art does not show any method of mounting magnetic or electrical pickups adjacent the strings of an acoustic guitar in such a way that the pickups are isolated from vibrations of the guitar top plate, to avoid tonal influence and feedback. In particular, the prior art does not show vibration-isolated mounting on a neck extension.

Accordingly, it is one object of the present invention to provide an acoustic-electric guitar that reduces amplification feedback;

It is a further object of the present invention to provide an acoustic-electric guitar with electric pickups mounted on a neck extension;

It is a still further object of the present invention to provide an acoustic-electric guitar with apertures in the top sound plate to allow access to the electric pickups and control panel; and It is another object of the present invention to provide an acoustic-electric guitar neck extension with a preformed nipple to fit flush with a cutaway portion of the guitar.

These and other objects of the present invention will become readily apparent upon further review of the following specification and drawings.

SUMMARY OF THE INVENTION

The present invention is an acoustic-electric guitar constructed so as to minimize feedback caused by amplification. To do this a longitudinal neck extension is placed within the body cavity, connecting the neck to the opposite end of the body. Usually blocks are mounted inside the body cavity at either end; the extension may attach to these. This neck extension touches neither the top nor bottom sound plates of the guitar.

Attached to this neck extension are the electric pickups and the controls. The controls may be mounted on a control panel attached to the neck extension. This neck extension may be solid, or it may be a box lined with metal foil for electrical shielding. The box also will have resonant frequencies which enhance the tone of the instrument in the same way that other resonant structures, such as the interior air space and the sides, enhance the tone by resonating.

The neck extension provides a solid base for the electric pickups, eliminating vibration of the pickups that is caused by mounting them on the top sound plate.

The pickups and control panel are mounted in a raised position over the neck extension. The control knobs extend through openings on the top sound plate, as do the pickups, so that those components can be in their usual position on the instrument.

BRIEF DESCRIPTION OF THE DRAWINGS

FIG. 3 is a top view in cross section.

FIG. 4 is a side view in cross-section of the pickup mounting.

Like reference characters denote similar features throughout the drawings.

DESCRIPTION OF THE PREFERRED EMBODIMENTS

Figure 1:
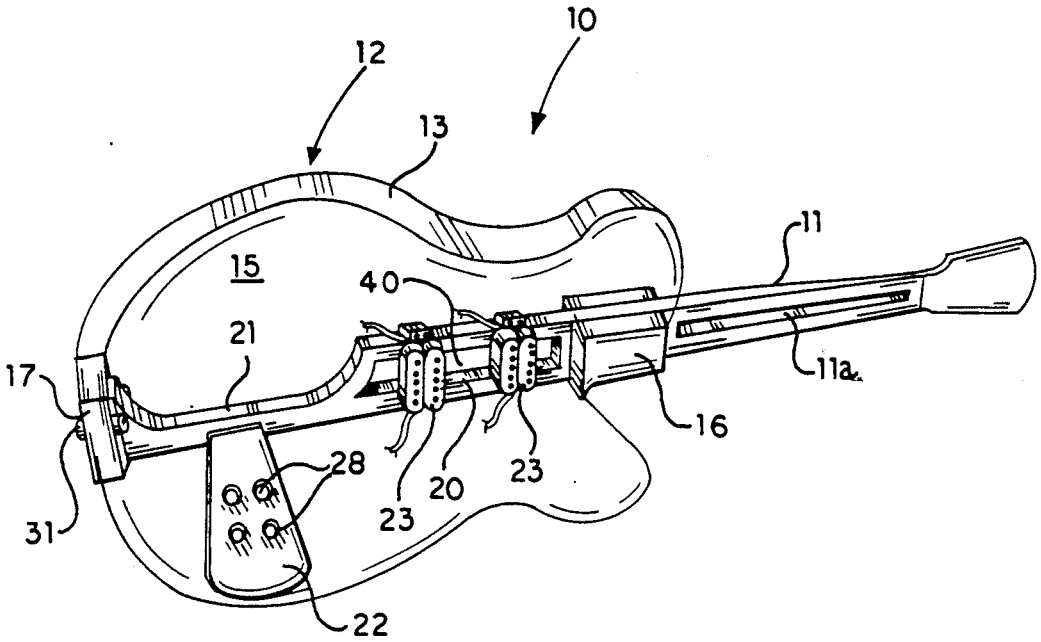
FIG. 1 is a top perspective view with the top sound plate lifted off.

Referring to the Figures, FIG. 1 shows the acoustic-electric guitar 10 having a neck 11, hollow resonant body 12, sidewall 13, and bottom plate 15. Top sound plate 14, not shown in FIG. 1, appears in FIGS. 2 and 4. A reinforcement plate 19 that would be placed behind the standard pin type bridge is shown in FIG. 3. Strings would be mounted over the neck 11 and a bridge as is conventional (these elements are not shown in the figures.

Figure 2:
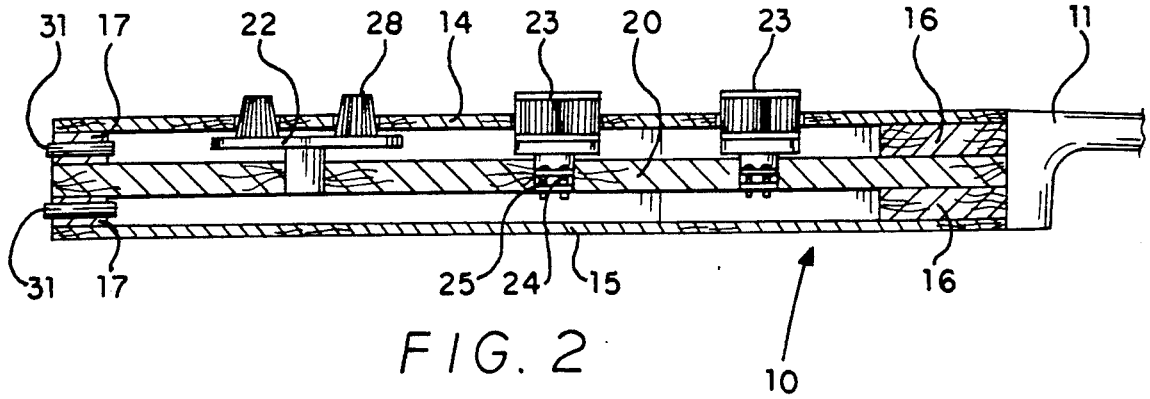
FIG. 2 is a side view of the guitar in cross section.

Referring to FIG. 3, the guitar body 12 has a front block 16 and a rear block 17. Mounted to the front block 16 by means of a notch 18 is neck 11. Mounted between the front block 16 and rear block 17 is neck extension 20. The neck extension 20 is mounted so that it divides the front and rear blocks 16, 17 in half vertically as shown in FIG. 2. The front end of the neck extension 20 is also mated to the neck by means of the notch 18.

The neck extension may in other embodiments extend longitudinally from one end of the body without reaching the other end, or, extend transversely. Such a transverse extension would be shorter and less liable to vibration.

Neck extension 20 is approximately ¾" thick and 3" wide. The length can be varied to suit the specific size of the guitar. Toward the rear of neck extension 20 is a thinner portion 21 that has been cut away to form a notch.

The reason for the thinning of portion 21 is to reduce the amount of vibration on the treble side of the body 12. This is similar to a piano soundboard being thickest on the treble side and thinnest on the bass side. This gives the bass side greater flexibility in response in order to produce low frequency notes.

Other variations in cross section of the neck extension may be adapted for acoustic purposes.

The central part of the neck extension 20 may optionally be removed to leave an opening 40, as shown in FIGS. 1 and 3. This reduces the mass of the neck extension.

Mounted to the thinner portion 21 is control panel 22. Control panel 22 contains the volume and tone knobs 28 and associated circuitry for the pickups 23. The panel may be a solid piece, or, alternatively (as shown in FIG. 5), the control panel may be formed as a box with a removable back. The inside of the box may be lined with conductive material such as copper foil to isolate the electrical parts inside from electrical fields, such as those from power lines.

The box, having stiff back, front and sides, and a trapped air space, will have acoustic resonant properties at certain frequencies. These may be chosen to augment the tone of the instrument by reinforcing corresponding notes. Resonance will occur if the box is open-backed, or closed; resonant frequencies will be different in the two cases, however.

Shielded cable connections are made between the pickups 23 and the control panel 22. Jacks 31 for plugging in an amplifier cord could be placed on the sidewall 13 toward the rear of the guitar. Jacks 31 would be for the signal from the electric pickups 23 and another piezo-type transducer pickup (not shown) that would be mounted under the bridge 19.

Pickups 23 are mounted on the neck extension 20 ahead of the thin portion 21. Any type of pickup 23 can be mounted on the neck extension, depending on the needs of the maker. As shown best in FIG. 4, the pickups 23 are mounted on a metal plate 24 by means of screws 25. The plate 24 is set in a channel 26 which is flush with the bottom of the neck extension 20. A mixture of Epoxy and aluminum powder is used to anchor the plate 24 in channel 26 The non-magnetic aluminum provides more mass in the pickup 23 mounting, giving better high volume capacity because of the high stability of the mounting.

This structure puts the pickups 23 in a raised position above the neck extension 20. The pickups 23 extend through apertures 27 in the top sound plate 14. The control knobs 28 of the control plate 22 also extend through similar apertures with the control plate 22 positioned just below the top sound plate 14, as shown in FIG. 2.

The top plate 14 of the guitar has double-X bracing 32 to strengthen it, as shown in FIG. 3. The bottom plate 15 may have the usual cross braces (not shown). The neck extension 20, neck 11 and blocks 16, 17 should be made of hardwoods such as Ash or Maple. The top 14 should be of spruce as is common for acoustic guitars. The neck additionally would also have the standard embedded aluminum reinforcement tubing 11*a* (shown in FIG. 1 and FIG. 3).

What is now provided is an acoustic-electric guitar that can be played with moderately high amplification levels without the worry of deafening feedback as was a problem with conventional acoustic-electric guitars prior to the applicant's invention.

It is to be understood that the present invention is not limited to the sole embodiment described above, but encompasses any and all embodiments within the scope of the following claims.

I claim:

1. An acoustic-electric guitar, including:

a hollow resonator having front and rear ends;

front and rear blocks at the respective ends of said resonator;

a guitar neck affixed to said front block and extending away from said resonator;

a neck extension affixed to and extending between said front and rear blocks inside said resonator;

electric pickups affixed to and disposed above said neck extension;

said hollow resonator having a flat, top sound plate, said top sound plate having apertures cut therethrough, and said electric pickups extending partially through said apertures;

one or more bracket plates mounted on an undersurface of said neck extension distal said top, said bracket plates in routed channels such that said plates lay flush with said undersurface of said neck extension;

said pickups mounted to said plates by means of elongated threaded fasteners disposed on either side of said neck extension.

2. An acoustic-electric guitar, including:

a hollow resonator having front and rear ends;

front and rear blocks at the respective ends of said resonator;

a guitar neck affixed to said front block and extending away from said resonator;

a neck extension affixed to and extending between said front and rear blocks inside said resonator;

electric pickups affixed to and disposed above said neck extension;

said hollow resonator having a flat, top sound plate, said top sound plate having apertures cut therethrough, and said electric pickups extending partially through said apertures;

said neck extension having a control panel affixed thereto, said control panel disposed above said neck extension and adjacent said top sound plate, and said control panel having control knobs affixed thereto;

said top sound plate having additional apertures cut therethrough, and said control knobs extending through said additional apertures;

a rear section of said neck extension adjacent said rear block partially cut away, providing a thin portion; and said control panel affixed to said thin portion.

3. A guitar as in claim 2, wherein said control panel further comprises a hollow box having a removable panel back, said box acts as a resonant cavity, and said box is lined with conductive material, whereby electromagnetic interference is minimized.

4. A guitar as in claim 2, wherein said neck extension includes an opening therethrough.

5. An acoustic stringed musical instrument of the type having a neck, a hollow body including sides, a back, and a top plate, and strings close to said top plate, wherein the improvement comprises:

a rigid extension having two ends, said extension disposed within the interior of said body, said extension fixed to said body at least one of said ends, said extension not in contact with said body except at said ends of said extension;

at least one pickup aperture through said top plate, each said aperture disposed adjacent said strings;

at least one electromagnetic pickup mounted to said extension, the number of said pickups equal to the number of said pickup apertures;

said pickups disposed within said pickup apertures to extend through said top plate;

said pickups not contacting said top plate; whereby said pickups may be positioned close to said strings without touching said top plate and thereby be isolated from the vibrations of said top plate.

6. An instrument as in claim 5 wherein said extension includes variable cross sections adapted for acoustic response.

7. An instrument as in claim 5 wherein said extension runs longitudinally through said body parallel to said strings.

8. An instrument as in claim 5 including an interior resonant cavity mounted on said extension, said cavity not in contact with said body.

* * * * *